US006156253A

United States Patent [19]

Ypma et al.

[11] Patent Number: 6,156,253

[45] Date of Patent: Dec. 5, 2000

[54] PROCESS FOR PREPARING CELLULOSE FIBERS

[75] Inventors: Marco Ypma, Duiven; Hendrik Maatman; Hanneke Boerstoel, both of Arnhem, all of Netherlands

[73] Assignee: Akzo Nobel N.V., Arnhem, Netherlands

[21] Appl. No.: 09/319,697

[22] PCT Filed: Dec. 3, 1997

[86] PCT No.: PCT/EP97/06955

§ 371 Date: Jun. 25, 1999

§ 102(e) Date: Jun. 25, 1999

[87] PCT Pub. No.: WO98/30741

PCT Pub. Date: Jul. 16, 1998

[30] Foreign Application Priority Data

Jan. 9, 1997 [NL] Netherlands ..... 1004958

[51] Int. Cl.[7] ..... D01F 2/02

[52] U.S. Cl. ..... 264/187; 264/211.16

[58] Field of Search ..... 264/187, 203, 264/211.16

[56] References Cited

FOREIGN PATENT DOCUMENTS

| | | |
|---|---|---|
| 168 876 A2 | 1/1986 | European Pat. Off. . |
| 60-209006 | 10/1985 | Japan . |
| 7-189019 | 7/1995 | Japan . |
| 762959 | 12/1956 | United Kingdom . |
| WO 95/20696 | 8/1995 | WIPO . |
| WO 9606208A1 | 2/1996 | WIPO . |
| WO 97/19207 | 5/1997 | WIPO . |
| WO 97/30198 | 8/1997 | WIPO . |

*Primary Examiner*—Leo B. Tentoni
*Attorney, Agent, or Firm*—Oliff & Berridge, PLC

[57] ABSTRACT

A process for preparing fibers from an optically anisotropic solution containing either one of cellulose or cellulose derivatives by extruding the solution through a non-corroding spinneret and coagulating the resulting extrudates in a coagulant, the coagulant being a liquid which contains mostly water and to which cations have been added.

3 Claims, No Drawings

PROCESS FOR PREPARING CELLULOSE FIBERS

BACKGROUND OF THE INVENTION

1. Field of the Invention

The invention pertains to a process for producing fibres from an optically anisotropic solution containing cellulose and/or cellulose derivatives, inorganic acids of phosphorus, and water by extruding the solution through a non-corroding spinneret and coagulating the resulting extrudates in a coagulant.

2. Description of Related Art

Such a process is known, int. al., from WO 96/06208. As is described in this application, cellulose fibres can be obtained by spinning and coagulating an anisotropic solution of cellulose in a solvent containing phosphoric acid and/or its anhydrides and water. In this application it is stated to be advantageous to employ a non-corroding. spinneret when spinning such a solution, e.g., a spinneret made of an alloy containing gold and platinum. WO 96/06208 discloses various coagulants. WO 97/19207 discloses a process for producing cellulose fibres from an anisotropic solution containing cellulose formate. This application also states that it is advantageous to employ a non-corroding spinneret when spinning the solution, e.g., a spinneret made of an alloy containing gold and platinum. In the process described in said non-prepublished patent-application the extrudates are coagulated in acetone and washed and dried under low tension.

The processes described in the aforesaid patent applications are especially suitable for the production of cellulose fibres having very good mechanical properties. The obtained fibres have a breaking tenacity which is (much) higher than the breaking tenacity of, say, Cordenka®, i.e., a tenacity in excess of 600 mN/tex. For that reason the fibres described are especially suitable for technical use, e.g., as reinforcement material in conveyor belts, V-belts, and car tyres.

A major drawback to the disclosed processes is that in order to obtain fibres having the aforementioned favourable mechanical properties, use is made of organic solvents as coagulant (e.g., acetone). However, the use of such solvents is not very desirable in view of a) the additional safety measures required to minimise the risk of explosions and/or fire, b) the personal protection measures required for staff working on or near a spinning machine, c) the additional steps required to clear the coagulant of impurities.

SUMMARY OF THE INVENTION

The invention now provides a process for producing cellulose fibres from an optically anisotropic solution by extruding the solution through a non-corroding spinneret and coagulating the resulting extrudates in a coagulant which does not have the above-mentioned drawbacks.

DETAILED DESCRIPTION OF PREFERRED EMBODIMENTS

The invention consists in that in a process of the known type mentioned in 20 the opening paragraph the coagulant is an at least 50 wt. % water-containing liquid comprising a phosphate salt which does not originate from the spinning solution.

It should be added that use of an aqueous solution containing water-soluble inorganic salts as a coagulation bath for regenerated cellulose was already known from JP-A-07 189019 and JP-A-60 209006. However, in both said prior art disclosures the cellulose is coagulated from an organic solvent and, optionally, water containing solution, which may require a totally different coagulation bath than a cellulose, phosphoric acid, and water-containing solution.

Not the slightest allusion is made in said prior art disclosures to the beneficial results that may be obtained by dissolving the cellulose in an inorganic solution, followed by coagulating in an at least 50 wt. % water-containing liquid comprising a phosphate salt which does not originate from the spinning solution.

In this patent application the term "fibres" refers to continuous filaments as well as short-length fibres (shorter than 100 mm, i.e. staple fibres) and fibres of greater length (>100 mm). The fibres can be bundled up into yarns, slivers or strands, or be processed to make fabrics or non-wovens.

The term "phosphoric acid" in the application refers to all inorganic acids of phosphorus and their mixtures. Orthophosphoric acid is the acid of pentavalent phosphorus, i.e. $H_3PO_4$. Its anhydrous equivalent, i.e., the anhydride, is phosphorus pentoxide ($P_2O5$). In addition to orthophosphoric acid and phosphorus pentoxide there is, depending on the amount of water in the system, a series of acids of pentavalent phosphorus having a water-binding capacity in between those of phosphorus pentoxide and orthophosphoric acid, e.g., polyphosphoric acid ($H_6P_4O_{15}$, PPA).

In the process according to the invention use is made of anisotropic solutions which contain cellulose and/or cellulose derivatives. Use may be made of solutions where cellulose is dissolved in an organic solvent, a mixture of organic solvents, an inorganic solvent, a mixture of inorganic solvents, or a mixture of organic and inorganic solvents. Also, use may be made of solutions of cellulose derivatives where a cellulose derivative or a mixture of cellulose derivatives is dissolved in an organic solvent, a mixture of organic solvents, an inorganic solvent, a mixture of inorganic solvents, or a mixture of organic and inorganic solvents.

In view of its processability the solution preferably contains 10 to 30 wt. % of cellulose and/or cellulose derivatives (weight percentage calculated on cellulose units). If so desired, substances which will facilitate the dissolution of cellulose and/or cellulose derivatives or improve the processability of the solution, or adjuvants (additives), e.g., to counter the degradation of cellulose and/or cellulose derivatives as much as possible, or dyes and the like may be added to the solvent or to the solution.

In the process according to the invention the anisotropic solution is extruded through a non-corroding spinneret, preferably at a temperature in the range of 0° to 100° C., preferably with the shortest possible residence time at elevated temperature being selected. More particularly, the solutions are extruded at a temperature in the range of 20° to 70° C. For other cellulose concentrations in the solution it holds that when the concentration is higher, the selected spinning temperature likewise will exceed the range indicated above, this in order to provide compensation for, int. al., the higher viscosity of the solution. In analogous manner it holds for lower concentrations that a lower spinning temperature may be selected. However, as the temperature of the solution is raised, so the risk of degradation and/or cellulose reaction with other constituents in the solution is increased.

Fibres having exceptionally good properties can be arrived at using solutions obtained making use of cellulose and phosphoric acid, such as a solution of cellulose in phosphoric acid, which is disclosed in WO 96/06208 in the name of Applicant, or a solution containing cellulose formate (obtained by a reaction of cellulose with formic acid) and phosphoric acid, which is disclosed, int. al., in non-prepublished patent application PCT/EP 9604662 in the name of Applicant.

The desired number of capillaries in the spinneret is dependent on the use of the fibres to be obtained. For instance, a spinneret can be used to make monofilaments, but it is equally well possible to make a multifilament yarn having 20 to 10 000, more particularly, 100 to 2000 filaments. To prepare such a multifilament yarn making use of a spinning solution containing a corrosive solvent, e.g., a spinning solution containing an acid or a mixture of acids, preferably a spinneret such as described in WO 95/20696 is employed. These spinnerets are made of an alloy containing gold and platinum. If so desired, the spinneret may be part of a cluster spinning assembly such as described in EP 168876.

Given the comparatively high viscosity of the anisotropic solution preferably use is made of non-corroding spinnerets containing rhodium and/or palladium. As disclosed in WO 95/20696, these spinnerets are especially suited to be used for spinning corrosive and/or high-viscous solutions.

In the process according to the invention the formed extrudates are coagulated in a liquid which contains mostly water and to which cations have been added. In this patent application that means a liquid which contains at least 50 wt. % of water and to which cations have been added which do not originate from the spinning solution. Fibres having especially favourable properties (high breaking tenacity) can be obtained if the extrudates exhibit no or very little swelling when they are brought into contact with the coagulating liquid. No or very little swelling is found especially when monovalent cations have been added to the coagulating liquid, such as $Li^+$, $Na^+$, $K^+$ or $NH_4^+$.

One way of adding the cations to the coagulating liquid is by dissolving a salt containing the cations in the coagulating liquid.

The use of a coagulating liquid containing at least 50 wt. % of water may also have a favourable effect on the heat stability of the formed fibres.

It was further found that the pH of the coagulating liquid may affect the mechanical properties of the fibres obtained, notably their breaking tenacity. Fibres having a high breaking tenacity can be obtained when the pH of the coagulating liquid is higher than 6.

With regard to the coagulating liquid in the spinning process being recycled, it is particularly advantageous if the salt added to the coagulating liquid contains an anion which is also present in the anisotropic (spinning) solution. For instance, it is especially advantageous when an anisotropic solution of cellulose in a solvent containing phosphoric acid and/or its anhydrides and water is processed as specified by the invention to add a phosphate to the coagulating liquid, e.g., a phosphate containing $Na^+$, $K^+$ or $H_4^+$.

The coagulation may be followed by washing, in combination or not with a neutralising treatment. The washing may take the form of placing the coagulated fibres in a container holding the washing agent, or by passing the fibres through a container holding the appropriate liquid in a continuous process and only then winding them onto a roller. According to a process which is very suitable for use in actual practice, washing is performed using washing plates or so-called jet washers, such as described in GB patent specification 762, 959. The washing agent used may be the coagulating liquid or water. Washing may take place at any temperature between the washing agent's freezing and boiling points, preferably at less than 100° C. in any case. The resulting fibres may be neutralised if so desired, but this is not required.

The neutralisation may be carried out immediately following the washing process, or else in between the coagulation and the washing step. Alternatively, the neutralisation may be carried out after the washing step, followed by a further washing step.

When a solution containing cellulose derivatives is employed, the fibres obtained by spinning the solution have to be regenerated in a separate step in order to obtain cellulose fibres. In that case it is especially advantageous to combine the neutralisation step with the regeneration. The regeneration of the fibres preferably takes place after the fibres have been washed. Alternatively, the fibres can be dried prior to regeneration. Regeneration may be carried out, e.g., by means of saponification, say with a caustic solution, or by means of a high-temperature steam treatment. However, fibres of cellulose derivatives can also be used for several applications, so the regeneration step is not obligatory.

It was found that the tension under which the fibres are washed and dried affects their mechanical properties. When a high tension is employed during washing and/or drying, as a rule fibres with a comparatively high modulus will be obtained. A low tension will generally give fibres with a high elongation at break.

The fibres obtained have very good mechanical properties such as tenacity and modulus, and favourable elongation. Because of the anisotropy of the solution and the possibility to affect these properties in the spinning process, fibres wanted for use in a wide range of applications can be obtained.

For instance, it is possible to obtain yarns having a tenacity of more than 500 mN/tex and/or a maximum modulus at an elongation of less than 2% of at least 14 N/tex, and a elongation at break of at least 4%. The fibres also possess good adhesion to rubber after a single impregnation with conventional adhesives, e.g. dipping with a resorcinol-formaldehyde latex (RFL) mixture. However, it is also possible to make fibres which have especially advantageous properties for use in textiles.

Furthermore, the linear density of the obtained fibres or bundle of fibres can be varied by the selection of the number of spinning orifices and the degree of drawing after extrusion. For instance, fibres can be made which have a filament linear density (filament tex) of less than 2 dtex, more preferably of less than 1.5 dtex. A low filament tex is especially advantageous when the fibres are used in textiles. Alternatively, it is possible to obtain a fibre bundle, e.g., a multifilament yarn, which has a linear density of more than 500 dtex, more particularly, of more than 1000 dtex. A high linear density of he yam or bundle combined with a high breaking tenacity is especially dvantageous for technical application of the fibres.

Especially for industrial use the process according to the present invention offers particular advantages with respect to ease of handling and safety, with no or little corrosion of the equipment to be used and, comparatively speaking, very easy recovery of the chemicals employed. This process is substantially less harmful to the environment than the known processes for making cellulose fibres on an industrial scale. All of this is reflected in an economically highly advantageous process.

In this way, in a very advantageous manner fibres are obtained which are especially suitable for use in rubber articles subjected to mechanical load, such as vehicle tires, conveyor belts, rubber hoses, and the like, as well as for use in textiles. Fibres having high tenacity and high modulus are especially suitable for the reinforcement of vehicle tires, e.g., car and lorry tires.

In general, the resulting fibres constitute an alternative to industrial and/or textile yarns such as nylon, rayon, polyester, and aramid. Further, the fibres can be pulped. Such pulp, mixed with other materials such as natural cellulose materials, e.g. hemp or flax, aramid pulp, polyacrylonitrile pulp, polyketone pulp or not, is highly suitable for use as a reinforcement material, e.g., in asphalt, cement and/or friction materials.

Measuring methods

Determination of anisotropy

Visual determination of the isotropy or anisotropy was performed with the aid of a polarisation microscope (Leitz Orthoplan-Pol (100x)). To this end about 100 mg of the solution to be defined were arranged between two slides and placed on a Mettler FP 82 hot-stage plate, after which the heating was switched on and the specimen heated at a rate of about 5° C./min. In the transition from anisotropic to isotropic, i.e., from coloured (birefringent) to black, the temperature is read off at virtual black. The transition temperature is indicated as $T_{ni}$.

The visual assessment during the phase transition was compared with an intensity measurement using a photosensitive cell mounted on the microscope. For this intensity measurement a specimen of 10–30 $\mu$m was arranged on a slide such that no colours were visible when crossed polarisers were employed. Heating was carried out as described above. The photosensitive cell, connected to a recorder, was used to write the intensity as a function of time. Above a certain temperature (differing for the different solutions) there was a linear decrease of the intensity. Extrapolation of this line to an intensity of 0 gave the $T_{ni}$. In all cases, the value found proved a good match for the value found by the above-mentioned method. A solution is deemed to be isotropic when it does not display any birefringence at room temperature. This means that $T_{ni}$ will be below 25° C. However, it may be the case that such solutions do not display an isotropy/anisotropy transition.

Determination of DP

The degree of polymerisation (DP) of the cellulose was determined with the aid of an Ubbelohde type 1 (k=0.01). To this end the cellulose specimens to be measured were dried in vacuo for 16 hours at 50° C. after neutralisation, or the amount of water in the copper II ethylene diamine/water mixture was corrected to take into account the water in the cellulose. In this way an 0.3 wt. % of cellulose-containing solution was made using a copper II ethylene diamine/water mixture (1/1). On the resulting solution the viscosity ratio (visc. rat. or $\eta_{rel}$) was determined, and from this the limiting viscosity ($\eta$) was determined in accordance with the formula:

$$[\eta] = \frac{visc.rat - 1}{c + (k \times c \times (visc.rat. - 1))} \times 100$$

wherein c=cellulose concentration of the solution (g/dl) and k=constant=0.25

From this formula the degree of polymerisation DP was determined as follows:

$$DP = \frac{[\eta]}{0.42} \text{ (for } [\eta] < 450\,\text{ml/g}), \text{ or}$$

$$DP^{0.76} = \frac{[\eta]}{2.29} \text{ (for } [\eta] > 450\,\text{ml/g})$$

Determining the DP of the cellulose in the solution proceeded as described above after the following treatment:

20 g of the solution were charged to a Waring Blender (1 liter), 400 ml of water were added, and the whole was then mixed at the highest setting for 10 minutes. The resulting mixture was transferred to a sieve and washed thoroughly with water. Finally, there was neutralisation with a 2%-$NaHCO_3$ solution for several minutes and after-washing with water to a pH of about 7. The DP of the resulting product was determined as described above, starting from the preparation of the copper 11 ethylene diamine/water/cellulose solution.

Mechanical properties

The mechanical properties of individual fibres/filaments and yarns were determined in accordance with ASTM standard D2256-90, using the following settings.

The filament properties were measured on filaments clamped with Arnitel® gripping surfaces of 10×10 mm. The filaments were conditioned for 16 hours at 20° C. and 65% relative humidity. The length between grips was 100 mm, the filaments were elongated at a constant elongation of 10 mm/min.

The yarn properties were determined on yarns clamped with Instron 4C clamps. The yarns were conditioned for 16 hours at 20° C. and 65% relative humidity. The length between grips was 500 mm, the yarns were elongated at a constant elongation of 50 mm/min. The yarns were twisted, the number of twists per meter being 4000/√linear density [dtex].

The linear density of the filaments, expressed in dtex, was calculated on the basis of the functional resonant frequency (ASTM D 1577-66, Part 25, 1968); the yarn's linear density was determined by weighing.

The tenacity, elongation, and initial modulus were derived from the load-elongation curve and the measured filament or yarn linear density.

The initial modulus (In. Mod.) was defined as the maximum modulus at an elongation of less than 2%. The final modulus was defined as the maximum modulus at an elongation of more than 2%.

Every measured value given for individual filaments was the average of ten separate measurements. Every measured value given for yams was the average of five separate measurements.

EXAMPLES

The invention will be further illustrated with reference to a number of unlimitative examples.

Example 1

A cellulose solution obtained according to the process described in WO 96/06208 and containing 18 wt. % of cellulose (Buckeye V60, DP=820), 60,9 wt. % of $P_2O_5$, and water was extruded at 46° C. through a non-corroding spinneret made of a gold, platinum, palladium, and rhodium alloy such as described in WO 95/20696, which was provided with 375 capillaries each having a diameter of 65 $\mu$m. The extruded solution was passed through an air gap of 15 mm and coagulated in a coagulation bath in water to which a salt had been added. The resulting yarn was washed with water, finished, and dried at 150° C.

The composition of the coagulating liquid was varied in the course of the experiment. Furthermore, some yams after being washed were neutralised with 2.5 wt. % of sodium carbonate solution ($Na_2CO_3$). On the thus obtained samples the mechanical properties of the yams and the filaments were measured. The data for the yarns (having a linear density of 1100–1200 dtex) is listed in Table 1, the filament data is listed in Table 2.

TABLE 1

(Yarn properties)

| | Coagulation bath water + | $T_{coag}$ (° C.) | $pH_{coag}$ | neutrali-sation | BT (mN/tex) | EaB (%) | IM (N/tex) |
|---|---|---|---|---|---|---|---|
| 1a | 20 wt. % $(NH_4)_2HPO_4$ | 24 | ±11 | – | 454 | 6.5 | 19.7 |
| 1b | 20 wt. % $(NH_4)_2HPO_4$ | 24 | ±11 | + | 451 | 6.7 | 19.4 |
| 1c | 20 wt. % $K_3PO_4$ | 29 | ±7 | – | 497 | 6.4 | 19.2 |
| 1d | 20 wt. % $K_3PO_4$ | 37 | ±7 | + | 488 | 6.9 | 18.6 |
| 1e | 5 wt. % $ZnSO_4$ | 23 | ±4 | – | 260 | 10.1 | 12.0 |
| 1f | 5 wt. % $ZnSO_4$ | 23 | ±4 | + | 260 | 10.6 | 11.5 |

in which $T_{coag}$ = temperature of the coagulating liquid, $pH_{coag}$ = acidity of the coagulating liquid, BT = breaking tenacity, EaB = elongation at break, and IM = initial modulus

TABLE 2

(Filament properties)

| | Lin. density (dtex) | BT (mN/tex) | EaB (%) | IM (N/tex) |
|---|---|---|---|---|
| 1a | 2.9 (±8%) | 480 (±8%) | 6.1 (±10%) | 26.4 (±6%) |
| 1b | 2.8 (±6%) | 490 (±6%) | 7.2 (±10%) | 26.0 (±5%) |
| 1c | 3.0 (±6%) | 510 (±10%) | 6.7 (±16%) | 24.9 (±4%) |
| 1d | 2.9 (±9%) | 510 (±18%) | 6.6 (±19%) | 25.0 (±9%) |
| 1e | 3.0 (±4%) | 280 (±6%) | 10.8 (±11%) | 16.8 (±5%) |
| 1f | 3.0 (±6%) | 260 (±12%) | 10.1 (±16%) | 16.4 (±7%) |

Example 2

The cellulose solution from Example 1 was spun at 62° C. in the manner described in said example. The extruded solution was passed through an air gap of 35 mm and coagulated in a falling liquid coagulator in water of 5–10° C. to which $K_3PO_4$ had been added. The resulting yarn was washed with water, finished, dried at 150° C., and wound at a rate of 100 m/min.

The $K_3PO_4$ concentration in the coagulating liquid was varied in the course of the experiment. Furthermore, some yarns after being washed were neutralised with 2.5 wt. % of sodium carbonate solution ($Na_2CO_3$). On the thus obtained samples having a linear density of 700–750 dtex the mechanical properties of the yarns were measured. Some results are listed in Table 3.

TABLE 3

| $K_3PO_4$ concentr. in the coagulating liquid | neutralisation | BT (mN/tex) | EaB (%) | IM (N/tex) |
|---|---|---|---|---|
| 1 wt. % | + | 306 | 6.8 | 15.5 |
| | – | 303 | 6.9 | 15.3 |
| 5 wt. % | + | 458 | 5.6 | 20.4 |
| | – | 446 | 5.4 | 20.0 |
| 10 wt. % | + | 478 | 5.4 | 20.7 |
| | – | 467 | 5.3 | 20.3 |
| 15 wt. % | + | 521 | 5.3 | 21.2 |
| | – | 515 | 5.3 | 21.2 |
| 25 wt. % | + | 519 | 5.3 | 20.9 |
| | – | 506 | 5.3 | 20.9 |

What is claimed is:

1. A process for producing fibres from an optically anisotropic solution comprising (1) at least one of cellulose and cellulose derivatives, (2) inorganic acids of phosphorus, and (3) water, said process comprising extruding the solution through a non-corroding spinneret and coagulating resulting extrudates in a coagulant to form fibers, wherein the coagulant is an at least 50 wt. % water-containing liquid comprising a phosphate salt which does not originate from the spinning solution.

2. The process according to claim 1, wherein the phosphate salt is a salt of phosphoric acid and monovalent cations.

3. The process according to claim 2, wherein the monovalent cations are selected from the group consisting of $Li^+$, $Na^+$, $K^+$, and $NH_4^+$.

* * * * *

UNITED STATES PATENT AND TRADEMARK OFFICE

CERTIFICATE OF CORRECTION

PATENT NO. : 6,156,253
DATED : December 5, 2000
INVENTOR(S) : Marco Ypma; Hendrik Maatman; and Hanneke Boerstoel It is certified that error appears in the above-identified patent and that said Letters Patent is hereby corrected as shown below:

Please amend the above-identified patent as follows:

Column 1,
Line 62, after "mentioned in" delete "20".

Column 2,
Line 27, change "($H_6P_4O_{15}$, PPA)." to -- ($H_6P_4O_{13}$, PPA). --.

Column 3,
Line 58, change "$H_4^+$." to -- $NH_4^+$. --.

Column 4,
Line 56, change "he yam" to -- the yarn --; and
Line 57, change "dvantageous" to -- advantageous --.

Column 6,
Line 49, change "yams" to -- yarns --.

Column 7,
Line 2, change "yams" to -- yarns --; and
Line 5, change "yams" to -- yarns --.

Column 8,
Line 38, after "coagulating" insert -- the --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*